US006939063B2

(12) United States Patent
Bussell

(10) Patent No.: US 6,939,063 B2
(45) Date of Patent: Sep. 6, 2005

(54) ON-LINE SYSTEM FOR PRINTING POSTAL INDICIA ON CUSTOM SIZED ENVELOPES

(75) Inventor: Keith Bussell, Los Angeles, CA (US)

(73) Assignee: Stamps.com, Santa Monica, CA (US)

( * ) Notice: Subject to any disclaimer, the term of this patent is extended or adjusted under 35 U.S.C. 154(b) by 0 days.

(21) Appl. No.: 10/040,934

(22) Filed: Dec. 31, 2001

(65) Prior Publication Data

US 2002/0110397 A1 Aug. 15, 2002

Related U.S. Application Data

(60) Provisional application No. 60/258,778, filed on Dec. 29, 2000.

(51) Int. Cl.[7] ..... B41J 2/00; B41J 5/00

(52) U.S. Cl. ..... 400/103; 400/61; 400/70; 400/76; 705/401; 705/408

(58) Field of Search ..... 400/67, 70, 76, 400/703; 705/401, 400

(56) References Cited

U.S. PATENT DOCUMENTS

| | | | | |
|---|---|---|---|---|
| 4,831,555 A | | 5/1989 | Sansone et al. | |
| 4,900,903 A | | 2/1990 | Wright et al. | |
| 4,900,904 A | | 2/1990 | Wright et al. | |
| 4,908,770 A | | 3/1990 | Breault et al. | |
| 5,048,085 A | | 9/1991 | Abraham et al. | |
| 5,111,030 A | | 5/1992 | Brasington et al. | |
| 5,152,122 A | * | 10/1992 | DeBarber et al. | 53/460 |
| 5,257,040 A | * | 10/1993 | Czernik et al. | 347/225 |
| 5,319,562 A | * | 6/1994 | Whitehouse | 705/403 |
| 5,454,038 A | | 9/1995 | Cordery et al. | |
| 5,688,056 A | * | 11/1997 | Peyret | 400/61 |
| 5,819,240 A | | 10/1998 | Kara | |
| 5,822,739 A | | 10/1998 | Kara | |
| 5,825,893 A | | 10/1998 | Kara | |
| 5,871,288 A | * | 2/1999 | Ryan, Jr. et al. | 400/103 |
| 5,923,942 A | * | 7/1999 | Nuggehalli et al. | 399/389 |
| 6,041,704 A | * | 3/2000 | Pauschinger | 101/91 |
| 6,282,524 B1 | * | 8/2001 | Kramer | 705/408 |
| 6,342,899 B1 | * | 1/2002 | Feinstein et al. | 345/619 |

OTHER PUBLICATIONS

Microsoft Word 2000, copyright 1983–1999, operating manual and help screens.*

* cited by examiner

*Primary Examiner*—Andrew H. Hirshfeld
*Assistant Examiner*—Leo T. Hinze
(74) *Attorney, Agent, or Firm*—Christie, Parker & Hale, LLP

(57) ABSTRACT

The present invention is directed toward a method and system for printing indicia, logos and graphics and more particularly to systems and methods for printing postal indicia on custom sized envelopes. A user navigates through a series of prompt screens to create a new custom envelope size for envelopes with irregular sizes. Postal indicia is then printed on a custom sized envelope.

7 Claims, 16 Drawing Sheets

126

ON-LINE SYSTEM FOR PRINTING POSTAL INDICIA ON CUSTOM SIZED ENVELOPES

CROSS REFERENCE TO RELATED APPLICATION

This application claims priority of provisional application Ser. No. 60/258,778 filed on Dec. 29, 2000, entitled "On-Line System for Printing Postal Indicia on Custom Sized Envelopes", the contents of which are herein incorporated by reference.

FIELD OF THE INVENTION

The present invention relates generally to systems and methods for printing indicia, logos and graphics and more particularly to systems and methods for printing postal indicia on custom sized envelopes.

BACKGROUND OF THE INVENTION

Metered postage is a significant source of revenue for the United States Postal Service (USPS). Metered postage is generated by utilizing postage meters that print a special mark, also known as postal indicia, on mail pieces. Generally, printing postage or any value-bearing items (VBI) may be accomplished with mechanical meters or computer-based systems.

With respect to computer-based postage processing systems, the USPS under the information-based indicia program (IBIP) has published specifications for IBIP postage meters. The IBIP involves the development of new technology to produce new forms of postage. In so-called PC postage systems, a user can purchase postage credit, and print the postage in the form of PC postage onto a label or directly onto a mail piece. The PC postage includes a human readable portion, an indicia graphic and a two dimensional barcode portion. The human readable portion includes the postage value, mail class, the date, the meter number, the licensing post office that a user registered with, an optional logo and optionally also the destination zip code (required for business courtesy mail pieces.) The barcode portion is intended to help thwart fraud, and includes information about the mail piece including the destination ZIP code, the amount of postage applied, the date and time the postage was applied, the meter number and a digital signature so that the USPS can validate the authenticity of the postage.

The USPS mail automation process utilizes various scanning machines when sorting the mail. Therefore, postage indicia must be printed in a prescribed manner to permit the mail handling and optical reading equipment to properly interpret the PC postage and addressee information. Indeed, the USPS has established strict guidelines directed to the margins, label sizes, and placement of the postage indicia, as well as the size, placement, and other characteristics of the POSTNET (POStal Numeric Encoding Technique) bar codes, and any facing identification mark (FIM) on mail pieces. These guidelines are contained in the Domestic Mail Manual (DMM) and Title 39, Code of Federal Register (CFR), Part 111, and USPS Publication No. 25 "Designing Letter Mail".

The scanning machines that the USPS utilizes have exacting standards for printed postal indicia. The postal indicia must be placed in the proper location on media in order for it to be read by the scanner. The various media types and sizes available to the user make this task difficult. This is a result of the different physical dimensions of the various media. The placement of the postal indicia is different with each different type and size of media. Therefore, it would be advantageous to provide a method and system for printing postal indicia on custom sized envelopes.

SUMMARY OF THE INVENTION

The present invention provides an on-line system for printing postal indicia on custom sized envelopes. The system includes, in an exemplary embodiment, a method for creating a custom envelope size that is available for use. This allows postal indicia to be printed on irregular sized envelopes.

A user creates this custom envelope size by navigating through a series of prompt screens. First the user is requested to choose a name for the custom envelope size. Then the user enters the width and height of the custom sized envelope. The custom sized envelope is placed on a template to verify that the envelope falls within the minimum and maximum envelope size range allowed for printing the postal indicia with the on-line postage system. Once this is accomplished, a sample envelope is printed with the postal indicia. A two step verification process ensures that the newly-created envelope meets the specifications provided by the USPS and Stamps.com. After the two step verification is complete, postal indicia is then printed on a custom sized envelope.

BRIEF DESCRIPTION OF THE DRAWINGS

These and other features, aspects, and advantages of the present invention will become better understood with regard to the following description, appended claims, and accompanying drawings where:

DETAILED DESCRIPTION OF THE INVENTION

An exemplary embodiment of the present invention enables postage systems to print indicia-based postage on a custom sized envelope within the constraints established by the USPS. The on-line postage system software comprises user code or client software that resides on a client system and controller code that resides on a server system. The on-line postage system allows a client to securely print a postal indicium at home, at the office, or any other desired place.

An exemplary online postage system may comprise a user system electronically connected to a server system, which in turn is connected to a USPS system. The server system is preferably capable of communicating with one or more client systems simultaneously. In operation, a licensed and registered client of the on-line postage system sends a request for authorization to print a desired amount of postage. A postal security device (PSD) server determines whether the client's account balance is sufficient to cover the requested amount of postage, and if so, communicates an authorization to the client system. The client system then sends image information for printing a postal indicium for the granted amount to a printer so that the postal indicium is printed on the print media, such as for example, an envelope, post card or label. The printed indicium appears as a two-dimensional bar code that includes a unique serial number, mail delivery point information, and the amount of postage. Once the postage information is printed on an individual piece of mail, it may be mailed and processed by the USPS.

Figure 1:
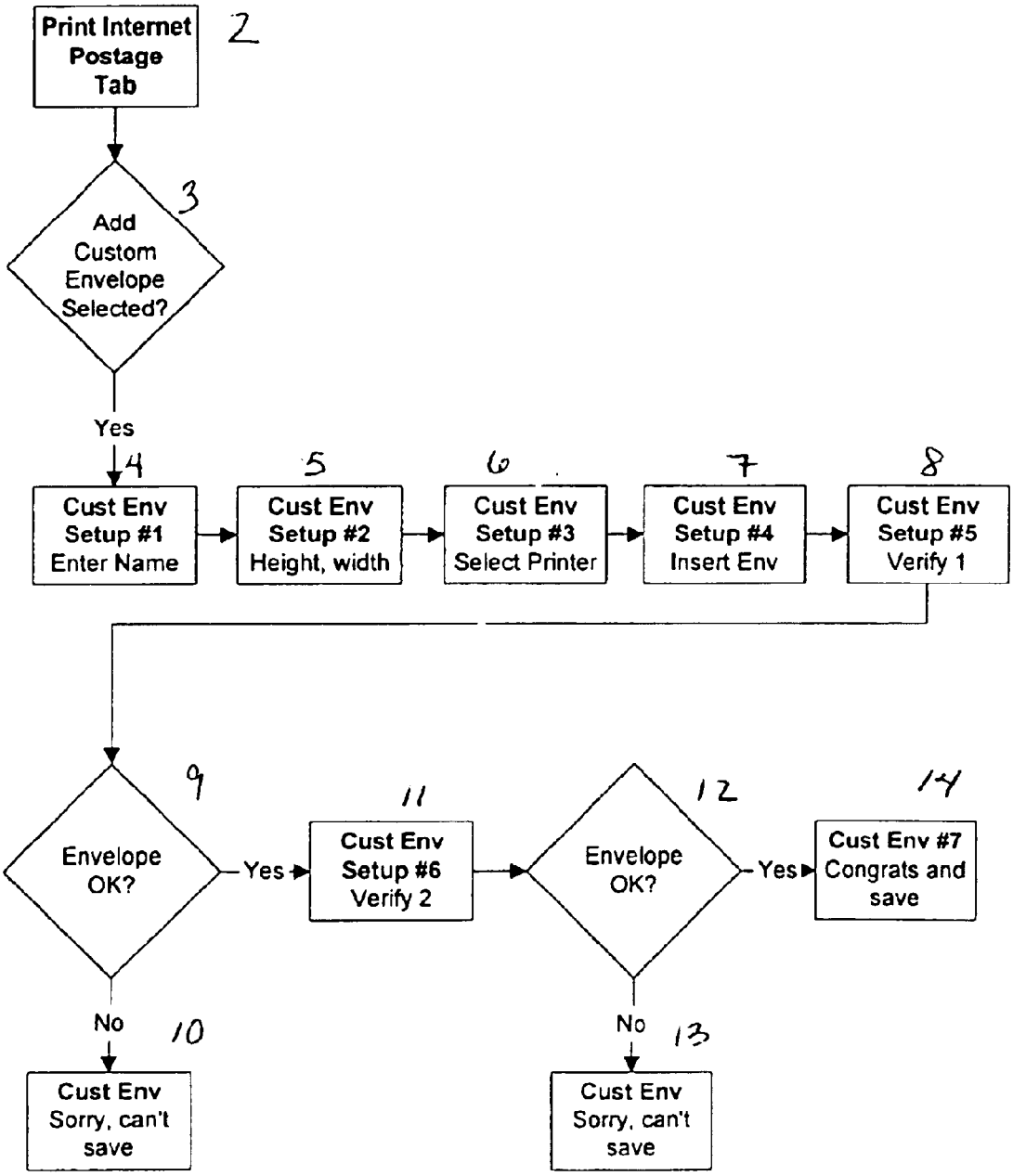
FIG. 1 is a flow chart demonstrating a process for printing postal indicia onto a custom sized envelope with an exemplary embodiment of the present invention.

Referring to FIG. 1, the present invention utilizes a combination of processes to print postal indicia onto custom sized envelopes in accordance with the regulations set forth by the USPS. In an exemplary embodiment of the present invention, the process of printing postal indicia on a custom sized envelope begins with creating a new custom envelope size that will be available for use in the on-line system. This is accomplished by following the on-line procedure that establishes the custom sized envelopes in the custom envelope manager. The first step is to select the print internet postage tab 2 from the main window. Next, the user decides to add a custom sized envelope 3 for future use. Details of the custom sized envelope are then entered. These details include the name of the custom sized envelope 4 and the height and width of the custom sized envelope in inches 5. After the details have been entered, the user selects the printer 6 and inserts the custom sized envelope into the printer 7 and prints a sample envelope. Next, the sample envelope is examined to verify 8 that the four pieces of indicium (FIN, human readable portion, indicium 2-D barcode and postnet barcode) meet the specifications defined by the USPS 9. If the sample indicium do not satisfy the USPS specifications, the custom sized envelope cannot be saved 10. If they do meet the specifications, the sample envelope is examined to verify 11 that the FIN is printed in the correct location on the custom sized envelope 12. If the FIN is printed in the wrong location, the custom sized envelope cannot be saved 13. If the FIM is printed in the correct location, the custom sized envelope is saved 14 for future use. The user can immediately begin using the custom sized envelope to print postal indicia without having to log off from the client software and re-start it. The user's computer does not have to be re-booted and a confirmation email from Stamps.com customer support is also not needed.

Figure 2:
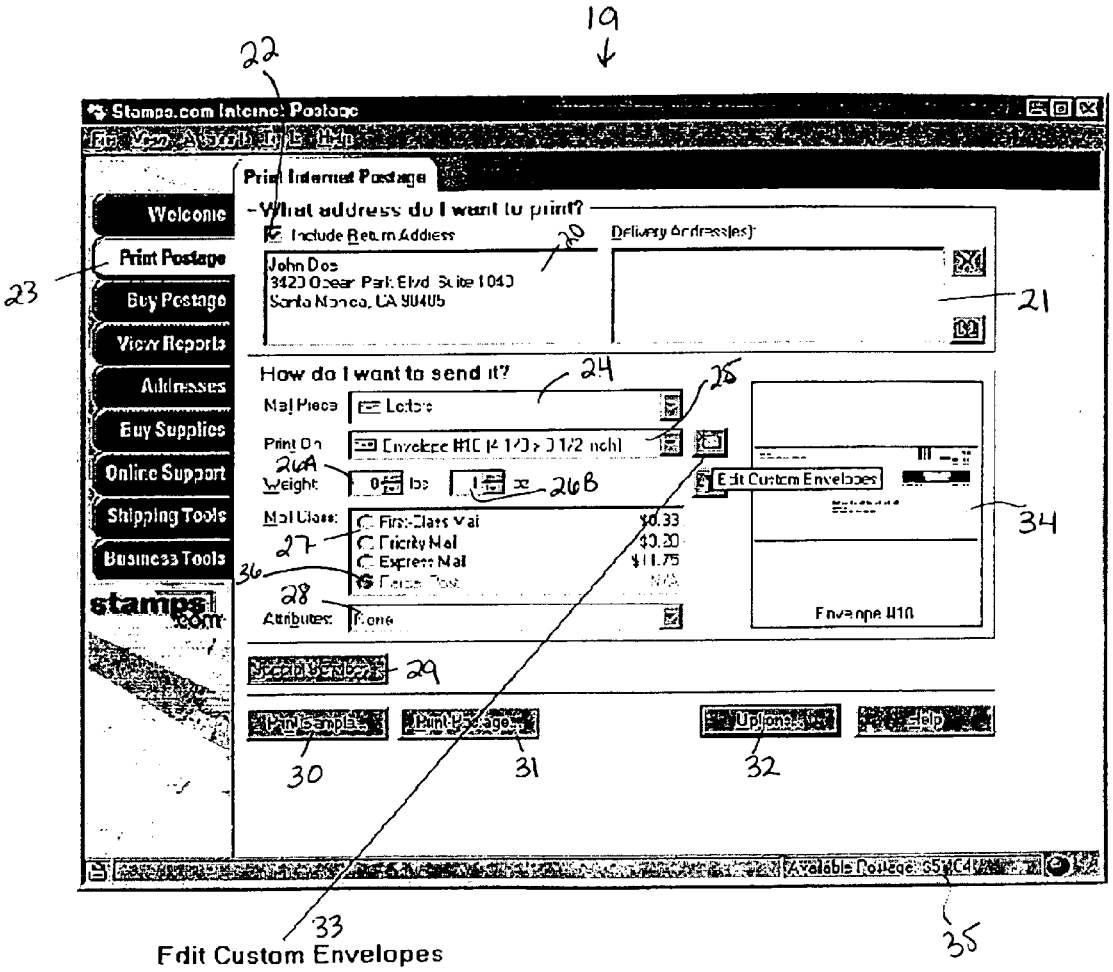
FIG. 2 is a capture of an exemplary print internet postage screen for a single recipient in accordance with an exemplary embodiment of the present invention.

An exemplary on-line postage system preferably provides a print internet postage interface from which a user may define the postage that is to be printed. The user selects the print internet postage screen 19 via toggle button 23. An exemplary print internet postage screen for a single recipient is shown in FIG. 2. The user may enter a return address by typing in a return address box 20. The user may omit the return address by de-activating an "Include return address" option 22. The omit return address option is preferably not active by default. Similarly, a delivery address box 21 preferably allows users to enter a delivery address by typing in the delivery address box 21. The system preferably displays the address of a single recipient in a format that is substantially the same as the format of the return address displayed in the return address window.

The exemplary print internet postage screen 19 preferably provides a mail piece drop down box 24 that allows users to select the type of mail piece to be sent, such as for example, a letter, flat, box or oversized box. The postage system preferably uses this information to determine what labels and/or envelopes are available to the user, and to establish the proper postage rate.

The exemplary print internet postage screen 19 further includes a print on down drop box 25 which allows users to select from envelopes, including custom sized envelopes, and labels. The items displayed in the drop down box 25 are preferably determined by the type of mail piece that was selected via the mail piece drop down box 24. For example, if a letter is selected, only envelopes and labels approved by the USPS may be available in the print on drop down box 25. Similarly, if a flat or box is selected, only labels approved by the USPS for the selected flat or box may be available. An exemplary embodiment of the present invention does not incorporate a default print onto media.

The exemplary print internet postage screen 19 allows users to enter the weight of an item to be mailed into weight fields 26A, 26B. The dimensions of the weight fields may be for example pounds and ounces. A default weight is preferably 0 lbs., 1 oz. After the initial use, the fields preferably remember the last value.

A mail class box 27, preferably displays a plurality of available classes as well as the cost of each type of service for the selected mail piece type. The prices preferably update as the user inputs information into the weight fields 26A, 26B. If the user is typing a value, the display may immediately update as the user types. The price may also update as a function of the delivery address of a mail piece. Once a user has selected a mail class, an indication, such as for example, a solid circle 36 may appear adjacent to the selected class. The exemplary on line postage screen 19 preferably does not select a default class type.

An available postage window 35 (reflecting the user's account balance) is preferably displayed on the print internet postage screen 19 as is a print preview window 34. The print preview window 34 is preferably updated in accordance with the media type selected in the print on drop down box 25. The selection of a print sample button 30 allows the user to print a sample postage indicia at no charge. The sample postage indicia will print with the word "VOID" across the bar-coded area and is not valid for mailing. The user may print as much sample postage indicia as is desired, on either envelope or label, all at no charge. The selection of a print postage button 31 allows the user to print postal indicia on a custom sized envelope.

Selection of an options button 32 on the print internet postage screen preferably advances the user to an options dialog box that corresponds to the media type selected in the print on drop down box 25.

Selection of an attributes drop down box 28 allows a user to select from a list any attributes that describe the Parcel Post packaging or package contents. Parcels with the identified attributes are subject to an additional mailing fee.

Selection of a special services button 29 opens the Special Services dialog box, which allows the user to send Certified Mail, Insured Mail, Return Receipt, Delivery Confirmation, or Registered Mail services for the mail piece.

Figure 3:
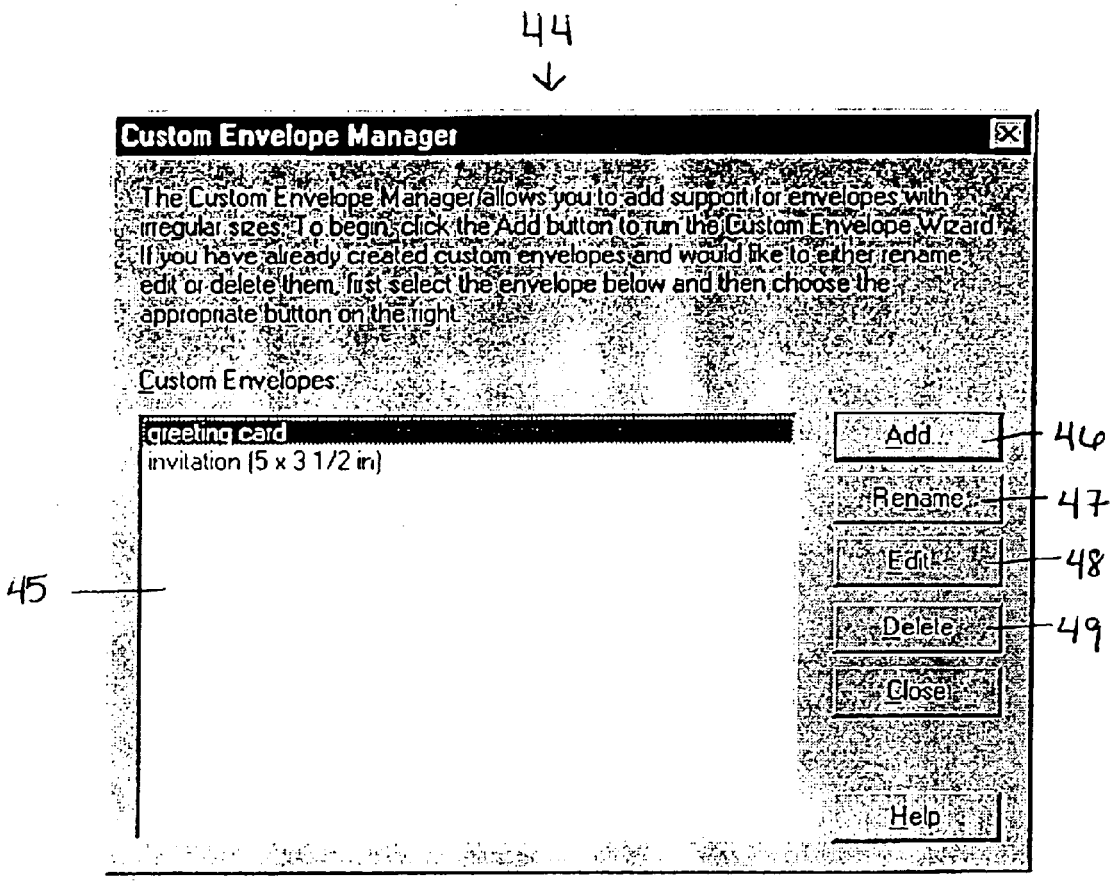
FIG. 3 is a capture of an exemplary custom envelope manager screen in accordance with an exemplary embodiment of the present invention.

Selection of the edit custom envelopes button 33 on the print internet postage screen advances the user to an exemplary custom envelope manager screen 44. From this screen, the user can dynamically create and support new envelope sizes for printing postal indicia. The exemplary custom envelope manager screen 44 is shown in FIG. 3. A custom envelopes box 45 displays a list of custom envelope sizes that are presently available for use. If no custom envelope sizes have been created, the custom envelopes box 45 will be empty.

A rename button 47, an edit button 48 and a delete button 49 on the custom envelope manage screen 44 allow the user to modify a custom sized envelope. Selection of the rename button 47 allows the user to change the name of a custom sized envelope that has already been installed. Selection of the edit button 48 allows the user to edit the dimensions of a custom sized envelope that has already been installed. Selection of the delete button 49 allows the user to remove a custom sized envelope from the custom envelopes box 45 and prevent further utilization.

Figure 4:
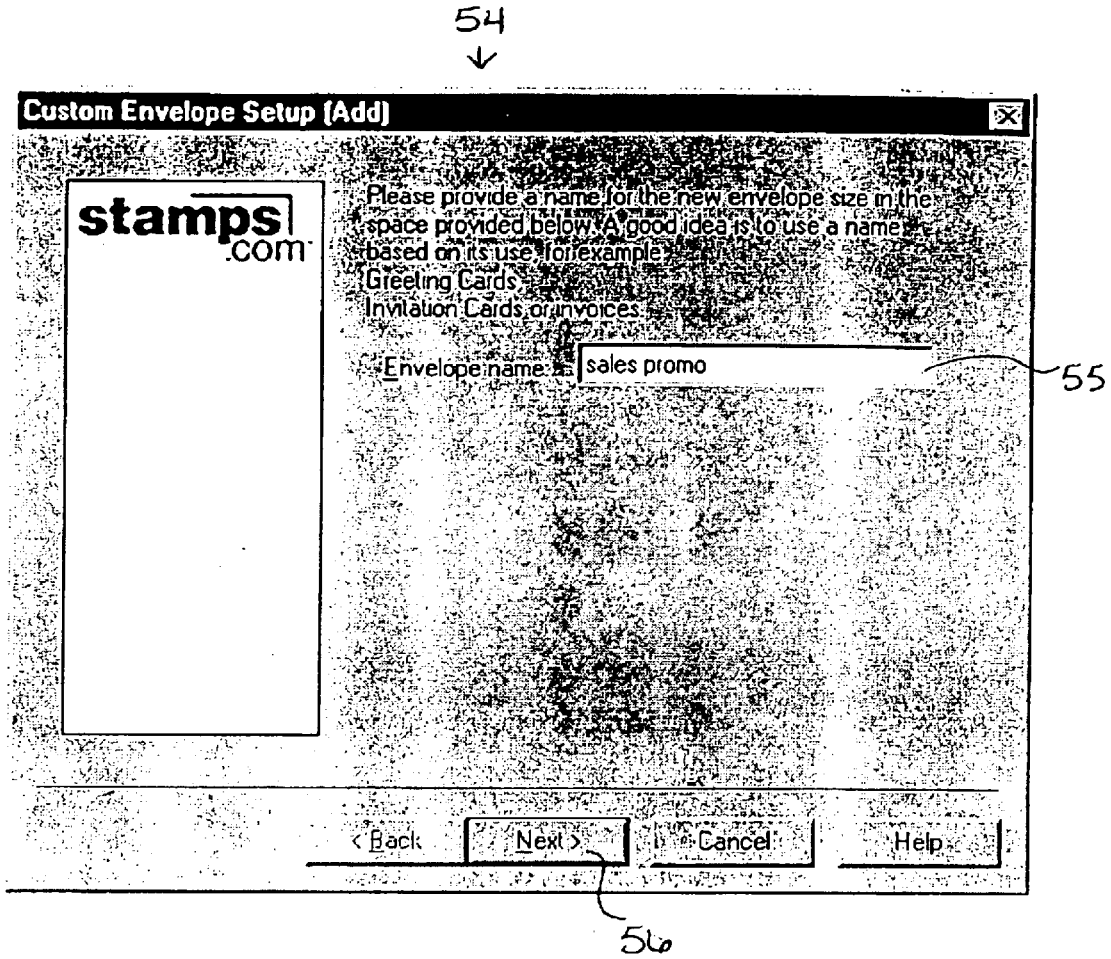
FIG. 4 is a capture of an exemplary custom envelope setup screen for establishing the name of a custom envelope in accordance with an exemplary embodiment of the present invention.
Figure 5:
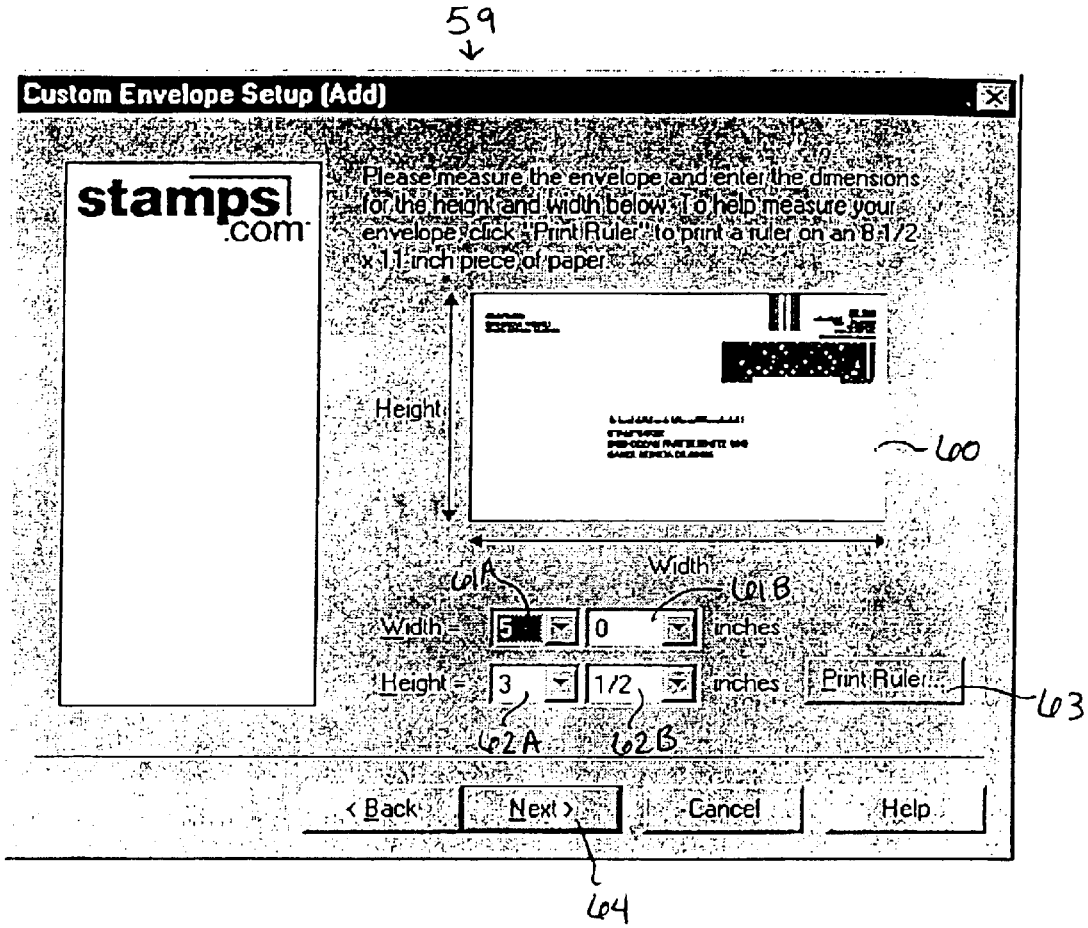
FIG. 5 is a capture of an exemplary custom envelope setup screen for establishing the dimensions of a custom envelope in accordance with an exemplary embodiment of the present invention.

The client software allows the user to add a new custom sized envelope by selecting an add button 46 from the custom envelop manager screen 44. Selection of the add button 46 advances the user to an exemplary custom envelope setup screen for establishing the name of the custom sized envelope 54. This screen is shown in FIG. 4. The user enters a name in the envelope name window 55. This name will appear in the custom envelopes box 45 as a custom sized envelope available for use after completion of the installation process. After entering a name, selection of the next button 56 advances the user to an exemplary custom envelope setup screen for establishing the dimensions of a custom sized envelope 59. This screen is illustrated in FIG. 5.

The exemplary custom sized envelope setup screen for establishing the dimensions of a custom sized envelope 59 allows a user to enter the dimensions of the new custom envelope size into width fields 61A, 61B and height fields 62A, 62B. The user chooses the height and width of the envelope in increments, such as, for example, sixteenths of an inch, from 5 to 9 inches wide and 3½ to 6⅛ inches high. The envelope display window 60 illustrates the new custom sized envelope.

Figure 6:
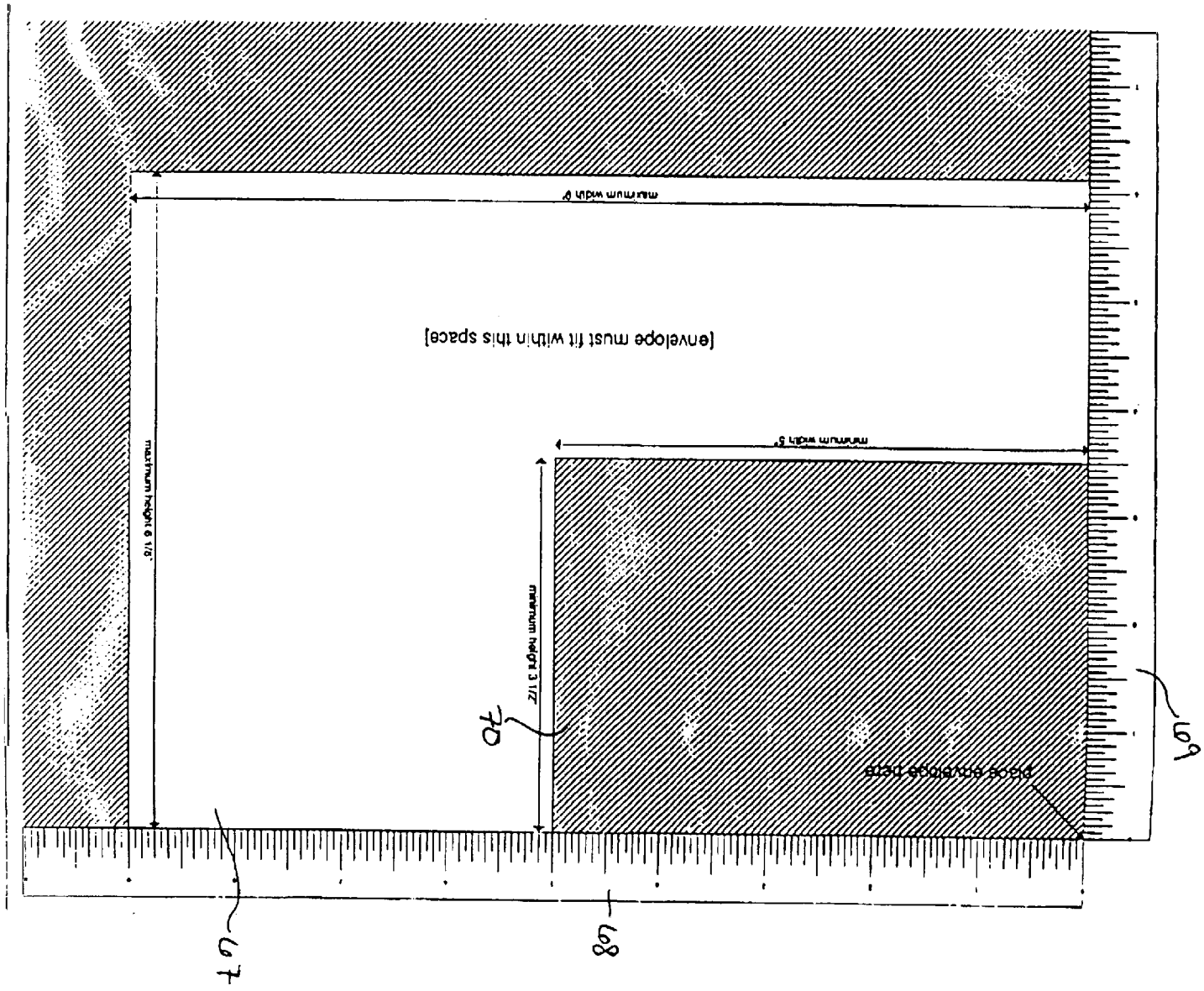
FIG. 6 is a ruler page illustrating the minimum and maximum height and width allowed for a custom sized envelope.

Selection of the print ruler button 63 prompts the client software to print a template illustrating the maximum size allowed for a custom sized envelope. This template is shown in FIG. 6. Rulers 68, 69 along the top and side of the template define the minimum and maximum height and width allowed for the new custom sized envelope. The maximum envelope size is the white area 67 within the boundaries of the rulers 68, 69 and the custom sized envelope must fit within this area indicated on the template. To verify the custom sized envelope is acceptable, the user places the custom sized envelope on the template and verifies the size required and the exact measurement for the correct height and width. The printed template also shows the minimum envelope size allowed in a shaded area 70. The envelope must fit within the white area 67 to accurately print the postal indicia on the custom sized envelope.

Figure 7:
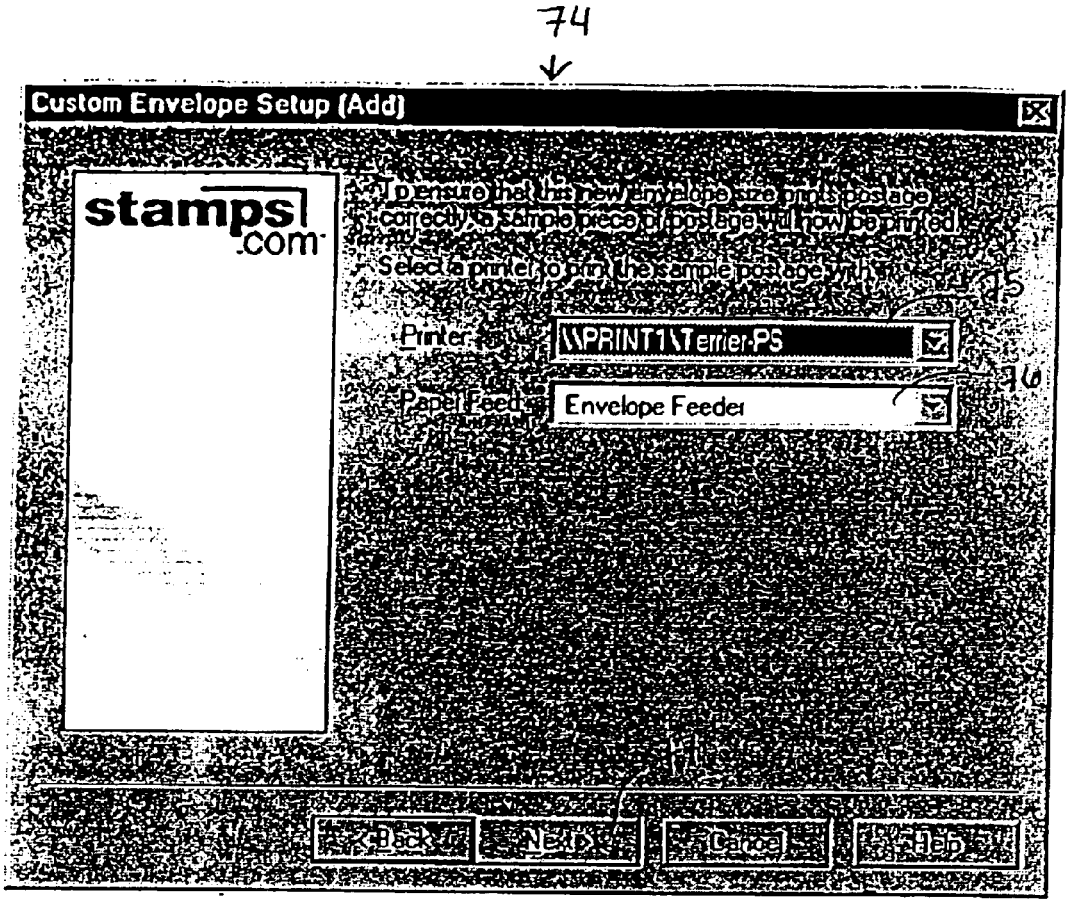
FIG. 7 is a capture of an exemplary custom envelope setup screen for printing a sample of the custom envelope in accordance with an exemplary embodiment of the present invention.

Once the dimensions of the new custom sized envelope have been entered on the exemplary custom envelope setup screen for establishing the dimensions of a custom envelope 59, the user selects the "Next>" button 54. This advances the user to an exemplary custom envelope setup screen for printing a sample of the custom envelope 74 as shown in FIG. 7. This screen informs the user that sample patterns need to be printed to ensure that the custom envelope size prints postage on the custom sized envelope correctly.

A printer drop down box 75 may display the printers that are installed on a user's system, and allows the user to select a default printer. The default printer selection is preferably incorporated into the standard print prepare dialog box, and therefore remains the default printer until the user selects otherwise. A paper feed drop down box 76 may display the possible paper feed options available on the selected printer, and allow the user to select a paper feed. In the described exemplary embodiment, a "Next>" button 77 is not available until the user selects a default printer.

Figure 8:
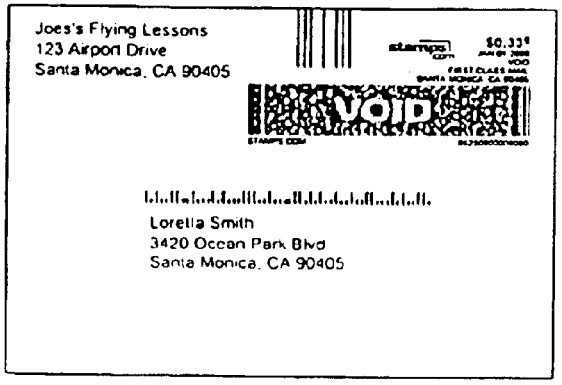
FIG. 8 illustrates a sample Quality Assurance envelope to verify the custom sized envelope meets specifications created by the USPS and Stamps.com.

After selection of the "Next>" button 77, the user is prompted to place the custom sized envelope in the printer, short-edge first and the printer prints the sample. A sample Quality Assurance (QA) envelope is preferably printed and is illustrated in FIG. 8.

Figure 9:
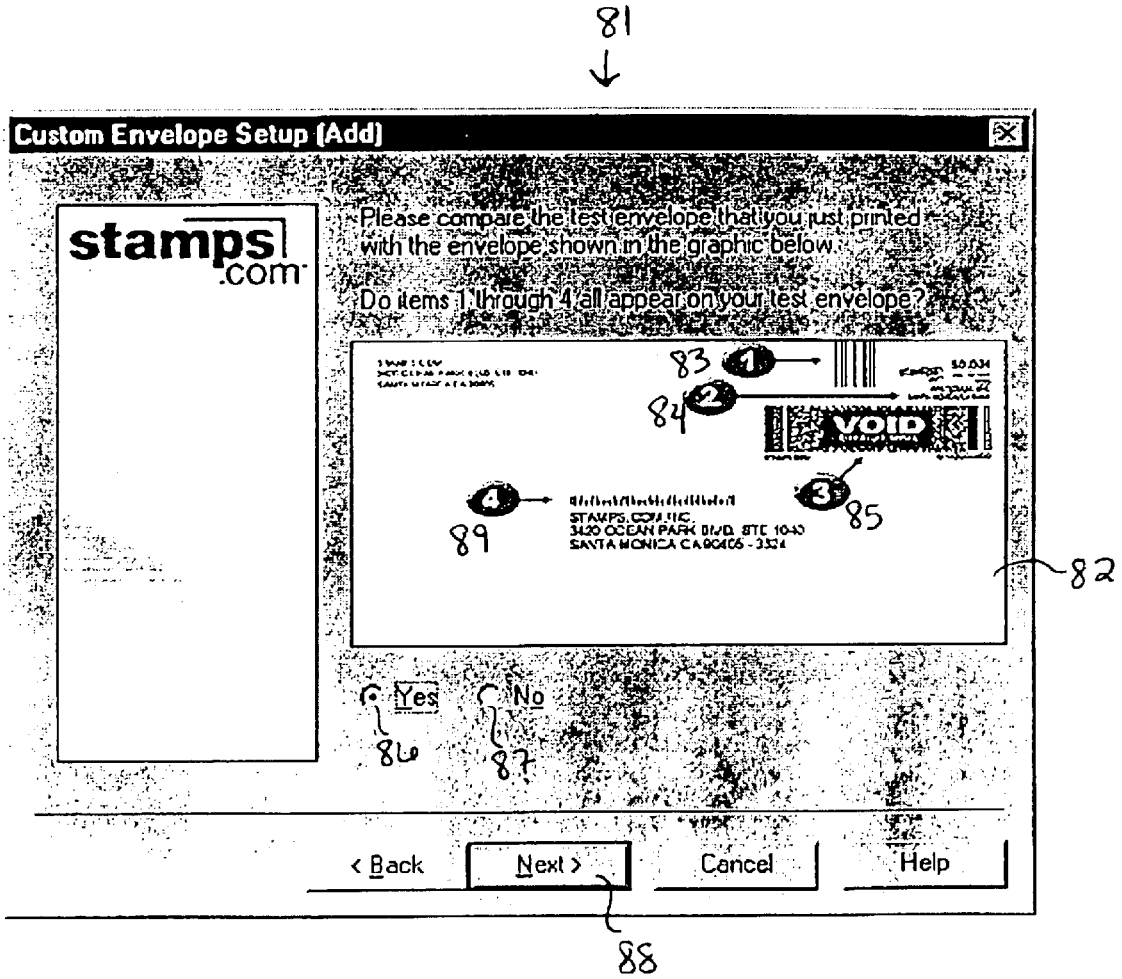
FIG. 9 is a capture an exemplary custom envelope setup screen for verifying the correctness of a custom envelope in accordance with an exemplary embodiment of the present invention.

An exemplary custom envelope setup screen for verifying the correctness of a custom envelope size 81 prompts the user to compare the QA envelope with the envelope 82 displayed on the screen. Verification is a two step process that ensures that the newly created custom sized envelope meets the specifications created by the USPS and Stamps.com. FIG. 9 illustrates the first step in the verification process which ensures that the QA envelope accurately shows the four pieces of indicium. The four pieces of indicium are (1) a FIM barcode 83, (2) a human readable portion 84, (3) an indicium two dimensional barcode portion 85, Stamps.com name and the registered meter number and (4) a postnet barcode portion 89. The human readable portion 84 includes the dollar amount, mailing date, mail class, and the city and zip code of the registered meter. The indicium two dimensional barcode portion 85 is intended to help thwart fraud, and may include information about the mail piece, such as for example, the destination ZIP code, the amount of postage applied, the date and time the postage was applied, and a digital signature so that the USPS can validate the authenticity of the postage. The postnet barcode portion 89 is for the delivery address. The user preferably verifies that each of the postal indicia features printed on the QA envelope match those displayed on the exemplary custom envelope setup screen for verifying the correctness of a custom envelope size 81. In an exemplary embodiment of the present invention, neither a "yes" radio button 86 nor a "no" radio button 87 is selected by default. A "Next>" button 88 is preferably not available until the user selects either the yes or no radio button.

Figure 10:
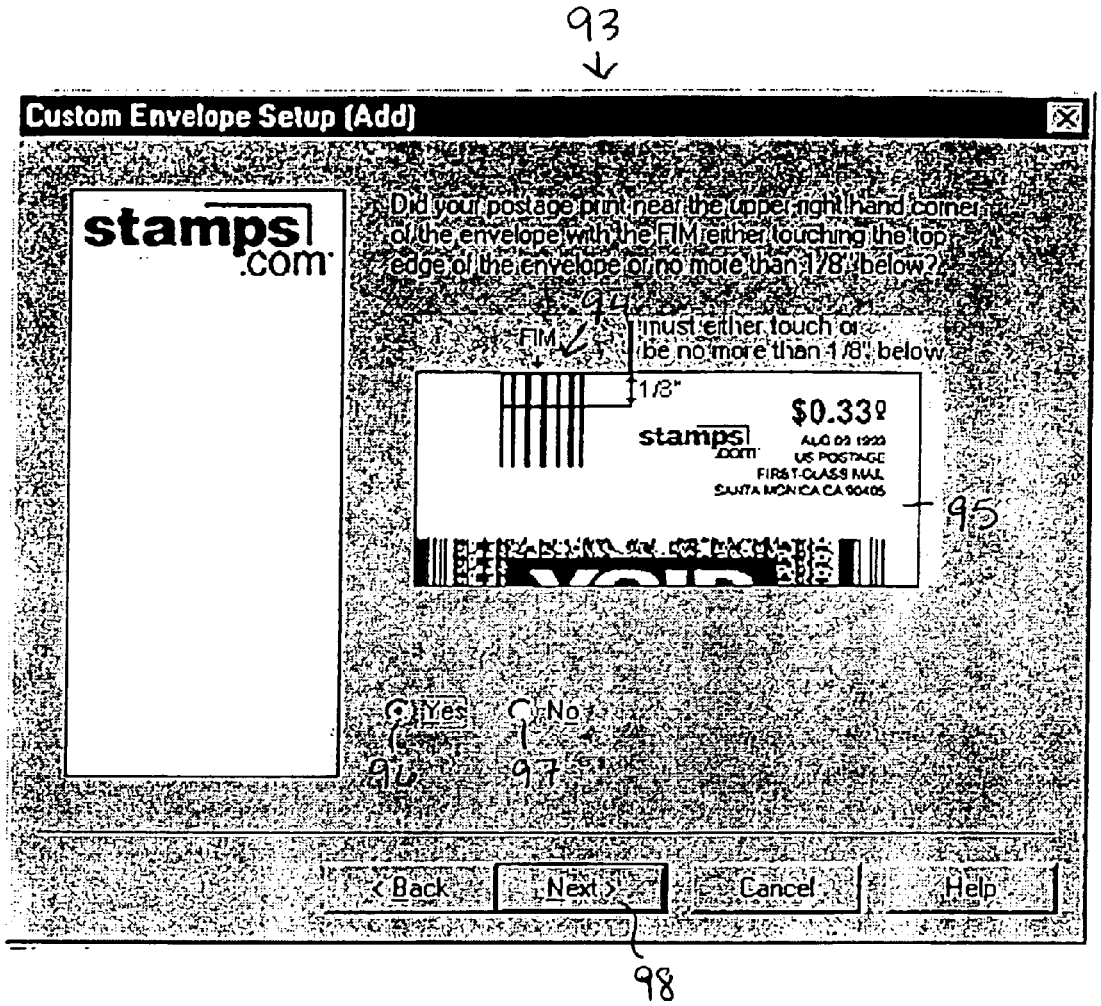
FIG. 10 is a capture an exemplary custom envelope setup screen for verifying the placement of the postal indicia on the custom sized envelope.

The user confirms the first verification step by selection of the "yes" radio button 86. The "Next>" button 88 is then available. Upon selection of the "Next>" button 88, the user is advanced to an exemplary custom envelope setup screen for verifying the placement of postage on the custom sized envelope 93 for the second step of the verification process. This screen is illustrated in FIG. 10. The second step involves ensuring the FIM 94 was accurately printed on an expanded view of the QA envelope 95. The FIM must either be touching the top edge of the envelope or not more then ⅛" below the top edge of the (QA) envelope. In an exemplary embodiment of the present invention, neither a "yes" radio button 96 nor a "no" radio button 97 is selected by default. A "Next>" button 98 is preferably not available until the user selects either the "yes" radio button or the "no" radio button.

Figure 11:
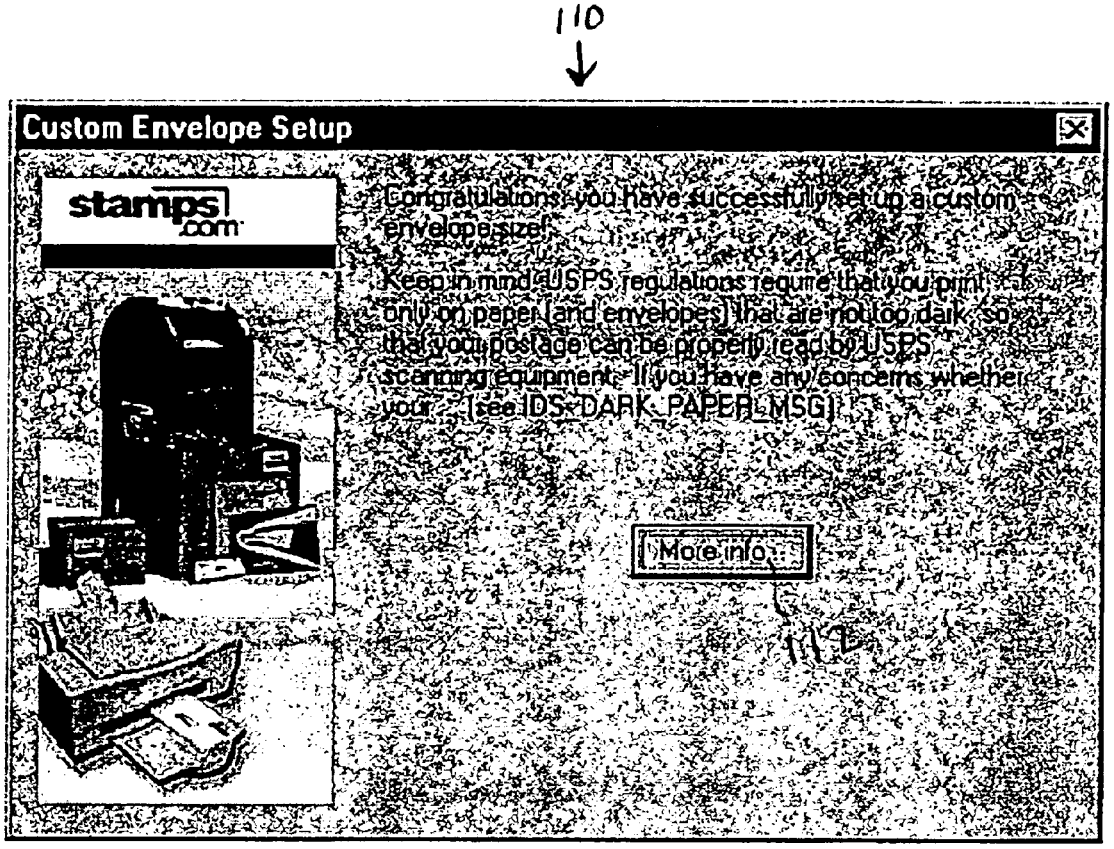
FIG. 11 is a capture of an exemplary custom envelope setup screen for advising the user of successfully installing a custom envelope size.

The user confirms the second verification step by selection of the "yes" radio button 96. The "Next>" button 98 is then available. Upon selection of the "Next>" button 98, the user is advanced to an exemplary custom envelope setup screen for advising the user of successful installation of a custom sized envelope 110. This screen is illustrated in FIG. 11. The screen confirms to the user that the new custom sized envelope has successfully been installed. It also informs the user of USPS regulations for printing. Selection of the "More info" button 112 provides the user with additional information regarding USPS regulations.

Figure 12:
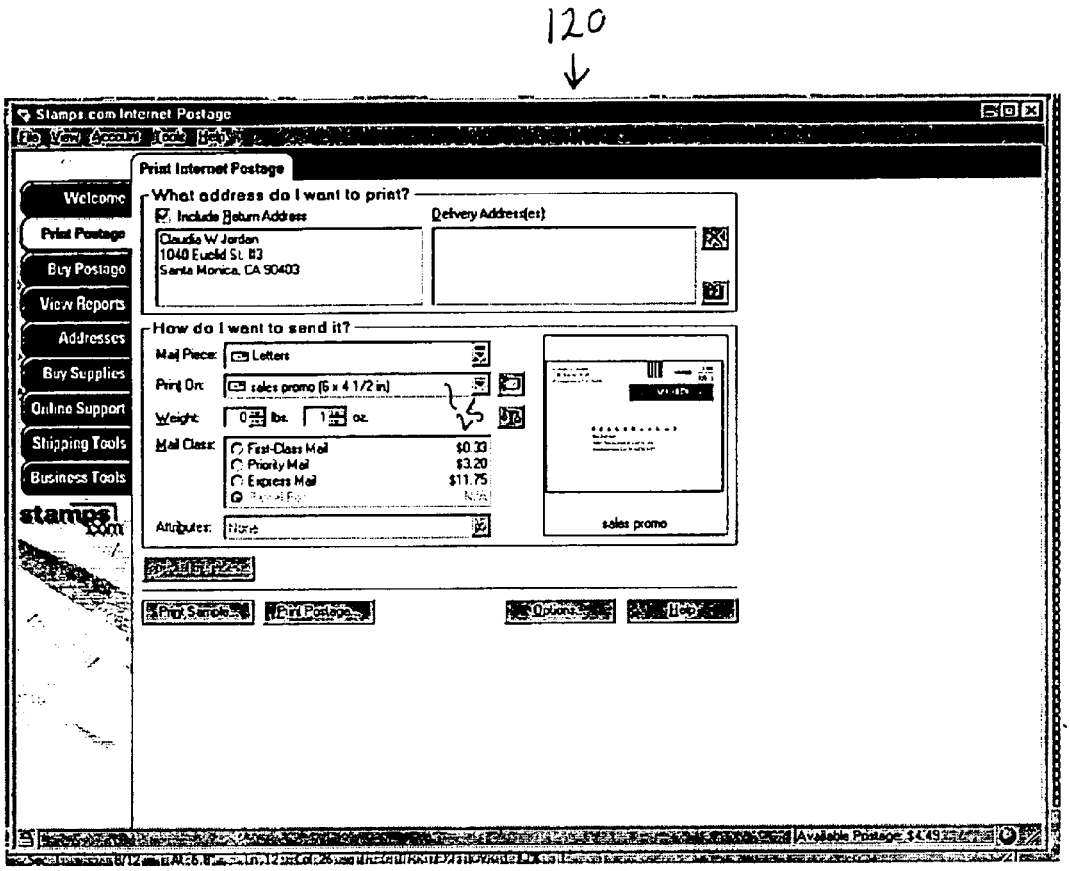
FIG. 12 is a capture of an updated exemplary print internet postage screen for a single recipient illustrating the newly created custom envelope as an available option in the print on drop down box in accordance with an exemplary embodiment of the present invention.

The custom sized envelope is now available for printing postal indicia. The name of the custom sized envelope chosen by the user appears in the print on drop down box 25 on the updated exemplary print postage dialog screen 120 as illustrated in FIG. 12. The new custom sized envelope is available until it is deleted by the user. Once a custom sized envelope has been created, it may be deleted or edited by using the custom envelope manager screen illustrated in FIG. 3.

Figure 13:
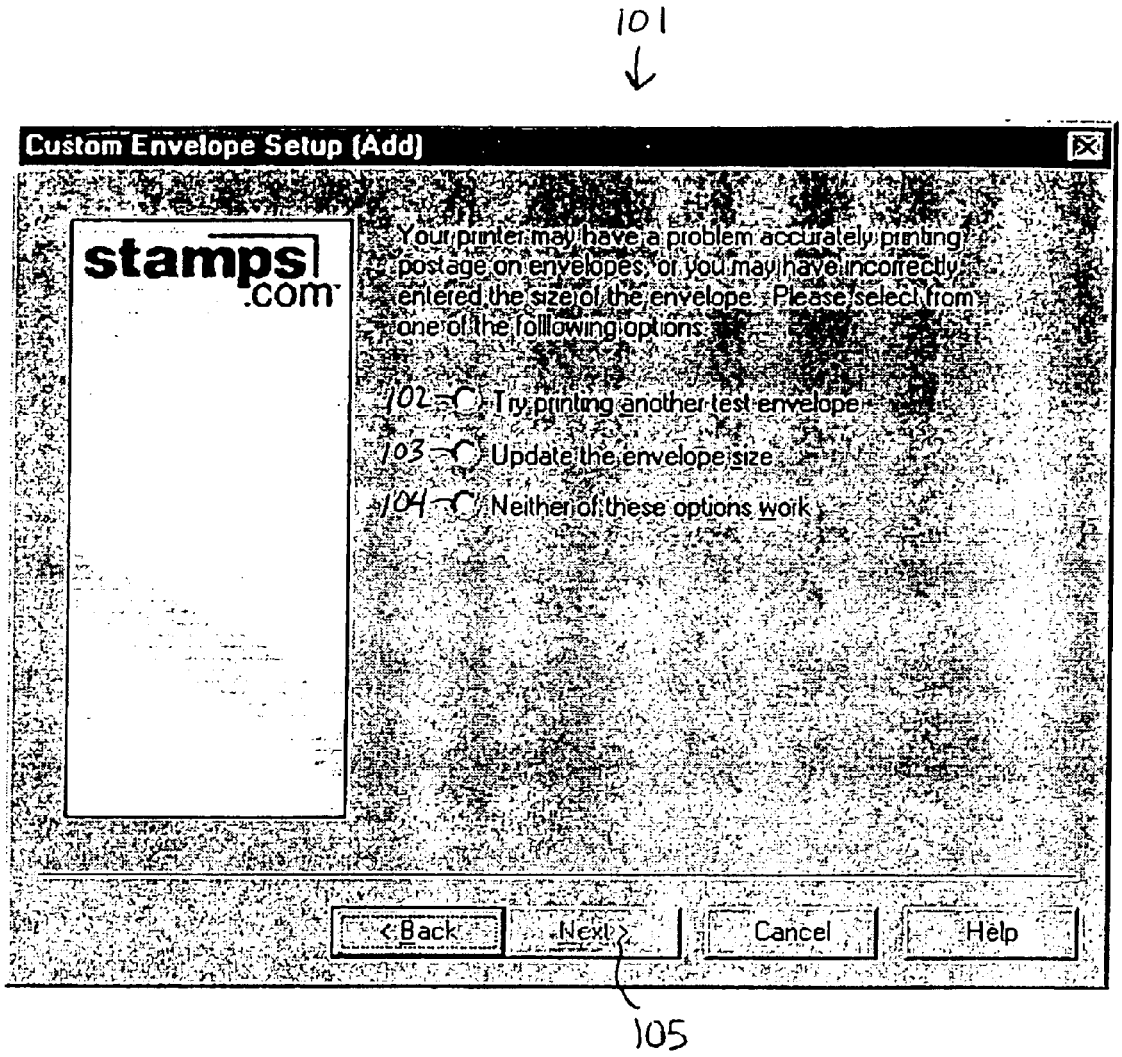
FIG. 13 is a capture of an exemplary custom envelope setup screen for trouble shooting a problem with printing the postal indicia on a custom sized envelope.

If the user selects a "no" radio button on FIG. 9 or FIG. 10, an exemplary custom envelope setup screen for trouble shooting 101 may appear as is illustrated in FIG. 13. The trouble shoot screen 101 preferably presents the user with a series of options and preferably prompts the user to select an option, by for example, selecting one of a series of buttons, each of which corresponds to a particular option. Possible options may include for example:

Try printing another test envelope 102. If the user selects this option, a different test pattern is sent to the printer, so that the comparison process may be undertaken again.

Update the envelope size 103. Selecting this option links the user back to the exemplary custom envelope setup screen for establishing the dimensions of a custom envelope screen 59, thus allowing the user to select new dimensions. The information on the failed custom sized envelope is not saved.

Neither of these options work 104. Selecting this option indicates that neither printing another envelope or changing the dimensions of the custom sized envelope corrects the problem.

Figure 14:
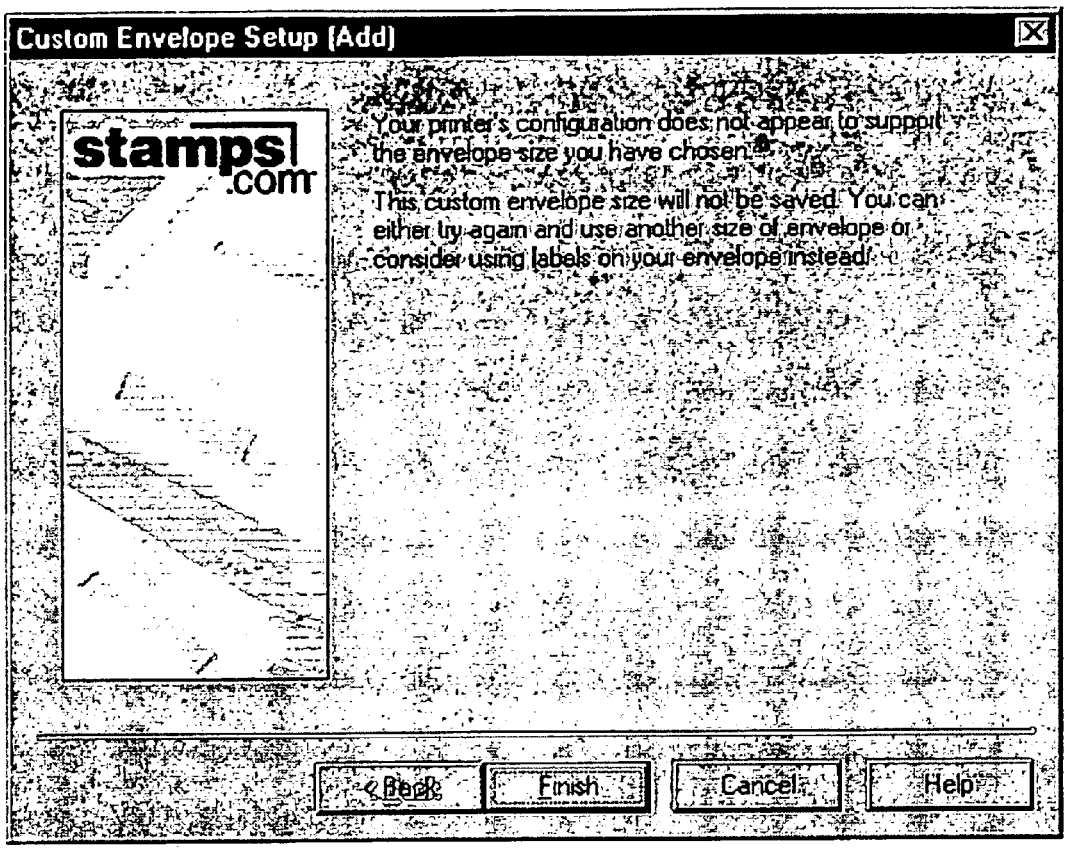
FIG. 14 is a capture of an exemplary custom envelope setup screen for advising the user of incompatible printer configuration.

If the user selects "neither of these options work" from the plurality of options in FIG. 13, the system preferably informs the user to call Customer support for more personalized assistance. A "Next>" button 105 may be immediately available. When the "Next>" button 105 is selected, the exemplary custom envelope setup screen for advising the user of incompatible printer configuration 126 is displayed. This screen is shown in FIG. 14. The client software indicates that the user's printer cannot support the new custom sized envelope. The custom sized envelope will not be saved. The user can either try again and use another size envelope or consider using labels on the envelope instead. The client software allows postage to be printed on several standard, non-custom sized envelopes as well as other print media. This print media includes mail pieces such as envelopes, self-sealed mailer, labels or postcards.

Figure 15:
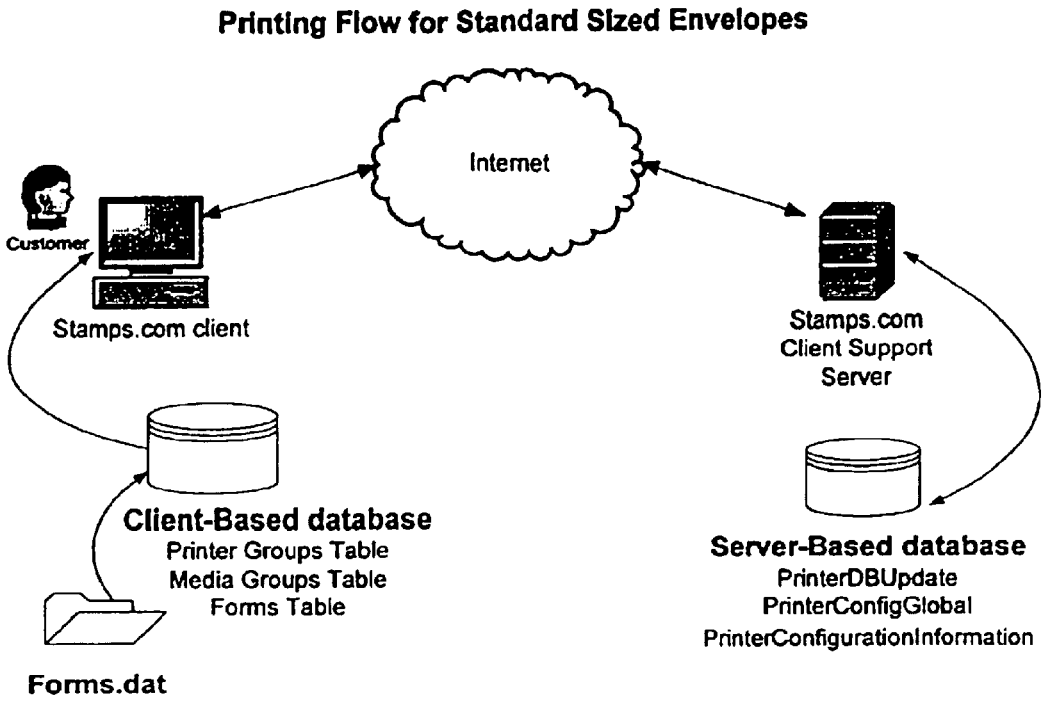
FIG. 15 illustrates the flow diagram for printing postal indicia on a standard sized envelope.

FIG. 15 illustrates how to print postal indicia on standard sized envelopes. The client software accesses non user-configurable information from a forms (print media) file in the Client-Based database, which is stored on the user's PC. During installation of the software, a forms.dat file is copied to the user's PC. This file is the source of the forms information the client software uses to print postal indicia. The various print media types from forms.dat appears in the print on drop down box 25 illustrated in FIG. 2

Additionally, a client-based printer database, may be located on the user's machine. The client-based printer database may include a forms database that defines which media types are supported (e.g., envelopes, labels, postcards and the like) and the dimensions of each of these media. In an exemplary embodiment of the present invention the print engine accesses the forms database to locate and print the indicium, delivery address, and return address.

The client-based printer database may also include a printer groups table and a media groups table. The printer groups table defines a list of printer drivers that only support certain print media (e.g., a label printer, which can only support labels designed for a label printer). The media groups table defines a list of media groups that are supported by a specific printer driver (e.g., a label group 1 can be printed by driver 1, driver 2 and driver 3).

When a user first tries to set up a printer with the client software, a Server-Based printer database is queried to determine if the user's printer driver information is contained within the database. If the printer information is in the database the required information is available and the user may continue. If the printer driver is not in the database, the user performs several tests to determine the required information with the guidance of a software wizard.

The Server-Based printer database may use a plurality of tables in a user support database to store information about printer drivers. For example, a printer configuration information table may be used to store information on known printer drivers (printer drivers that have been tested successfully, either in house or by a consensus of users' results) and the print media they support. Similarly a printer global configuration table may be used to store settings that affect all printer drivers, both known and unknown, and a printer database update table may be used to store the results generated when a customer configures a previously unknown printer.

In addition to these tables, information that is specific to a user's printers (i.e., driver version numbers, whether or not a printer has been configured, etc.) may be stored in the Registry. Each time a user logs into the postal service using the client software, a plurality of information is preferably sent to the postal service provider over the Internet. For example, the most recent date when the printer information in the Registry was updated with the printer information from the server based printer database may be sent. In addition, the names of printer drivers and printer driver version numbers that are installed on the user's computer are also preferably sent to the postal service provider.

The latest update or server date represents the date when the Server-Based printer database was last updated. If the date in the Registry is more recent than this server date, then the server does not update the printer information in the Client-Based printer database. If the date in the Registry is earlier or the same as the server date, then updated printer information from the Server-Based printer database may be returned to the client based printer database. The client software then preferably updates the printer information in the Registry and updates the date information with the current system date.

The printer configuration information table is the main table in the print server database. It contains information on printer drivers, such as for example, the version number, compatible operating systems, and the print media the drivers support. The printer configuration information table may also store the lowest version of the printer driver that meets all the criteria in the table. The printer engine compares the driver version number of a user's printer with the driver version(s) listed in the database. The printer engine preferably breaks up the string based on punctuation and then compares the numerical groups. If letters are included in the driver version, the engine does a character by character comparison.

When a user prints postage indicia on a standard sized envelope, the client software accesses both the client-based database on the user's PC and the server-based database over the internet. FIG. 15 illustrates a flow diagram for printing postal indicia on a standard sized envelope. To print on a standard sized envelope, the client software must copy the forms.dat file to the Client-Based database on the user's PC during installation. When the user logs on, the client software begins the printing process with pre-printing steps that occur at login. These steps include gathering behavioral information about the printing device to be used, gathering default information about the print device to be used, reading data from the forms.dat file and storing the data in memory. To print, the customer displays the print postage tab and the client software displays standard envelope sizes in print on drop-down list 25 illustrated in FIG. 2. The customer selects a standard sized envelope from the print on drop down list. The client software completes pre-rendering algorithms based on the envelope size the customer selects by determining (1) whether or not to virtualize (2) whether or not to virtualize and rotate the envelope image (3) what size paper to virtualize to and (4) if the user can print the selected envelope at all. Finally, the client software is now ready and employs several rendering algorithms to (1) set up the drawing surface (2) shift the origin to position the image correctly and (3) render the envelope image. Once the customer loads the selected size envelope in the printer, the client software prints postage information on the envelope and the envelope exits the printer.

Figure 16:
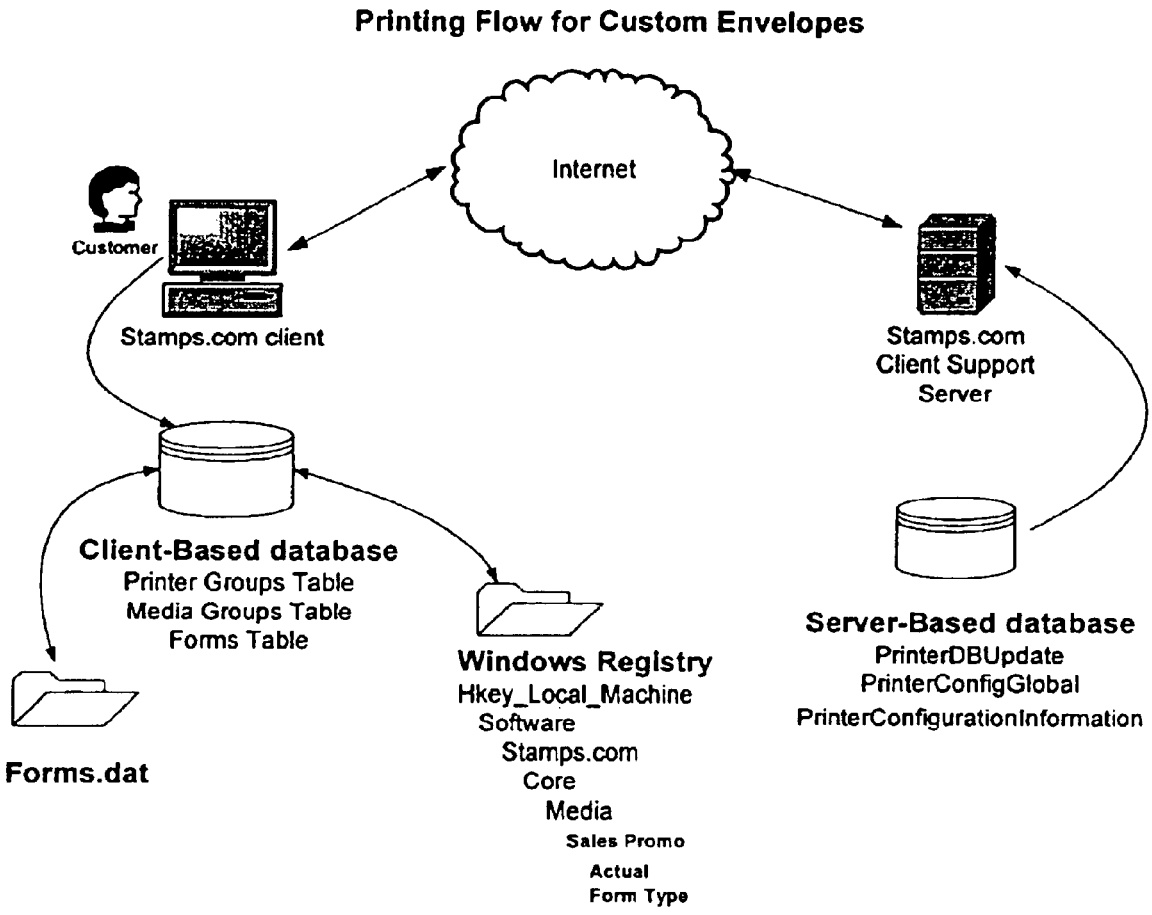
FIG. 16 illustrates the flow diagram for printing postal indicia on a custom sized envelope.

To print on a custom sized envelope, the client software uses the same non user-configurable information stored in the forms.dat file in the client-based database and the printer information in the Server-Based database. FIG. 16 illustrates a flow diagram for printing postal indicia on a custom sized envelope. To support the dynamically created sizes in the custom envelope manager, the client software stores user-configurable information in the Registry in the user's personal computer. As the user proceeds through the custom envelope manager, the client software collects new envelope specifications and stores the custom information in the Registry.

After the user creates and stores the envelope size in the custom envelope manager, the envelope is ready to print. When a user prints a custom sized envelope, the client software accesses the Client-Based and Server-Based databases as well as the new values stored in the user's registry.

Figure 17:
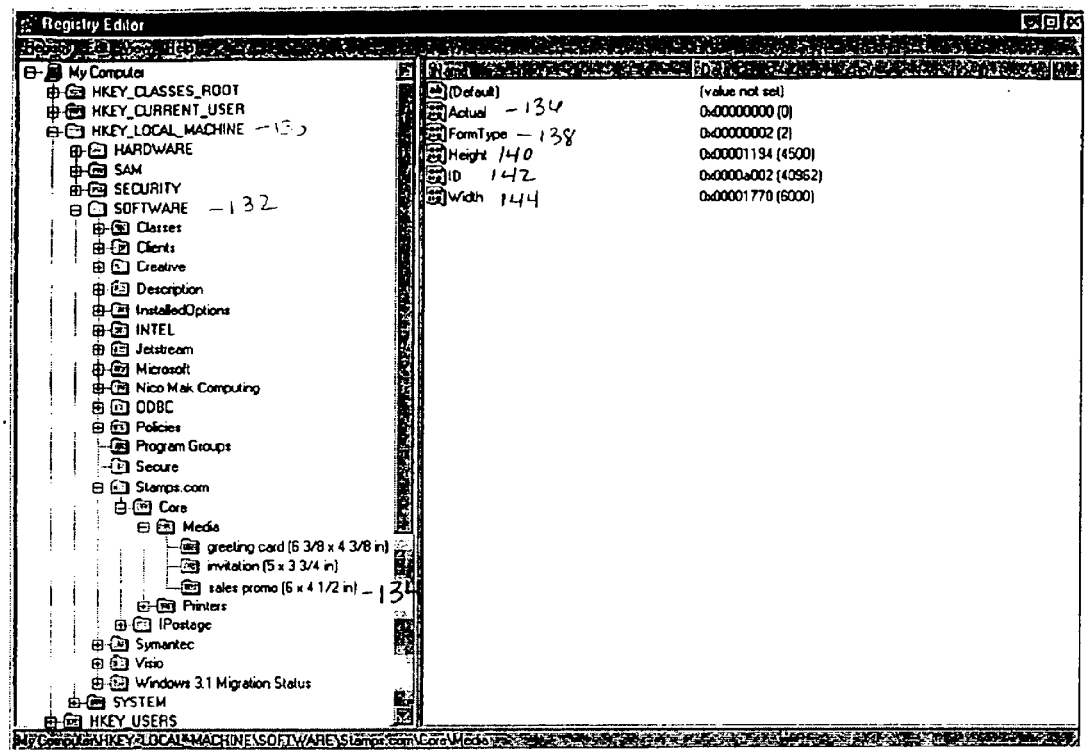
FIG. 17 illustrates the Registry hierarchy.

The name of the mail piece or custom sized envelope is stored as a registry sub-key under the Stamps.com key. The Stamps.com key is located under the root key, Hkey_Local_Machine 130, under the Software key 132. The envelope size "sales promo" 134 was created using the custom envelope manager and is now a Registry key under the Stamps.com sub-key, in the Registry hierarchy illustrated in FIG. 17.

The Registry Editor window shows the Registry entries as they are displayed. New registry values are stored for each new custom sized envelope or mail piece created. These new values include (1) Actual 136, which is a flag used to identify whether the mail piece is an envelope or postcard (2) Form Type 138, which is a field used to identify either an envelope or a label (3) the height 140 in inches of the new envelope size (4) ID 142 which is an automatically generated numeric start value used to identify a specific envelope and (5) width 144 in inches of the new envelope size.

The Custom Envelope Manager validates only the size entered by the user. If the user enters the size that does not match the size of the envelope, the envelope will print incorrectly and therefore not pass the two validation steps. The user must enter the size accurately to print the envelope correctly.

To print a custom sized envelope, assuming the user has already configured a printer to successfully print internet postage using the Stamps.com software product, the client software must copy the forms.dat file to the client-based database on the user's PC during installation. When the user logs on, the client software begins the printing process with pre-printing steps that occur at login. These steps include gathering behavioral information about the printing device to be used, gathering default information about the print device to be used, reading data from the forms.dat file, reading user-configurable data from the Registry and storing the data in memory. To print, the user displays the print postage tab and the client software displays the newly-created custom sized envelope in the print on drop down list. The user then selects a custom sized envelope from the print on drop down list. The client software completes pre-rendering algorithms based on the envelope size the customer selects by determining (1) whether or not to virtualize (2) whether or not to virtualize and rotate the envelope image (3) what size paper to virtualize to and (4) if the user can print the selected envelope at all. Finally, the client software is now ready and employs several rendering algorithms to (1) set up the drawing surface (2) shift the origin to position the image correctly and (3) renders the envelope image. Once the user loads the custom sized envelope in the printer, the client software prints postage information on the envelope and the envelope exits the printer.

Although a preferred embodiment of the present invention has been described, it should not be construed to limit the scope of the appended claims. For example, the present invention may be implemented by a variety of computer based postage metering systems in accordance with a variety of print requirements promulgated by postal systems around the world. Further, although the operation of the present invention has been demonstrated in accordance with the USPS requirements for PC based postal printing, the present invention is not limited to applications in accordance with the USPS requirements. Rather, the present invention is equally applicable for operation in all PC postal printing systems.

In addition, those skilled in the art will understand that various modifications may be made to the described embodiment. Moreover, to those skilled in the various arts, the invention itself herein will suggest solutions to other tasks and adaptations for other applications. It is therefore desired that the present embodiments be considered in all respects as illustrative and not restrictive, reference being made to the appended claims rather than the foregoing description to indicate the scope of the invention.

What is claimed is:

1. A method of printing postal indicia on a custom sized envelope comprising, and not necessarily in the following order:

assigning at least one custom sized envelope name to a custom sized envelope in client software that permits a plurality of custom sized envelopes to be created and stored;

determining a size of said custom sized envelope;

selecting a height of said custom sized envelope;

selecting a width of said custom sized envelope;

allowing a user to at least one of modify, add and delete a custom sized envelope name in the client software;

accessing printer information stored in a server-based database;

having the client software complete pre-rendering algorithms based on the envelope size selected by determining whether to virtualize;

rendering a postal indicia in accordance with the selected width and height of said custom sized envelope, the postage indicia comprising machine readable data representing postage value; and printing the postal indicia on said custom sized envelope using the printer information from the server-based database to determine when it is necessary to virtualize and if so, what size paper to virtualize to.

2. The method of claim 1 wherein determining the size of the envelope comprises placing the envelope on a user generated template.

3. The method of claim 1 wherein printing postal indicia on the custom sized envelope further comprises printing a FIM on the custom sized envelope.

4. The method of claim 3 wherein printing said FIM on the custom sized envelope further comprises printing said FIM within a predefined distance of an edge of said custom sized envelope.

5. The method of claim 4 further comprising verifying correct placement of the FIM on the custom sized envelope.

6. The method of claim 1 further comprising storing the selected width and height and custom name of the custom sized envelope on a printer database server.

7. The method of claim 1 wherein rendering a postal indicia in accordance with the selected width and height of the custom sized envelope comprises setting up a drawing surface and shifting an origin of a virtualized sheet to position an image of the envelope in a printable area of the virtualized sheet.

* * * * *